US006852366B2

(12) United States Patent
Zschaeck

(10) Patent No.: US 6,852,366 B2
(45) Date of Patent: Feb. 8, 2005

(54) METHOD FOR APPLYING LIQUID, PASTY OR PLASTIC SUBSTANCES TO A SUBSTRATE

(75) Inventor: Michael Zschaeck, Munich (DE)

(73) Assignee: Beiersdorf AG, Hamburg (DE)

( * ) Notice: Subject to any disclaimer, the term of this patent is extended or adjusted under 35 U.S.C. 154(b) by 0 days.

(21) Appl. No.: 10/277,507

(22) Filed: Oct. 22, 2002

(65) Prior Publication Data

US 2003/0091736 A1 May 15, 2003

Related U.S. Application Data

(63) Continuation of application No. PCT/EP01/03868, filed on Apr. 5, 2001.

(30) Foreign Application Priority Data

Apr. 20, 2000 (DE) ..... 100 20 101

(51) Int. Cl.[7] ..... B05D 3/12; B05C 3/18

(52) U.S. Cl. ..... 427/356; 427/207.1; 427/359; 427/428; 118/302; 118/406; 118/410; 118/415; 118/641

(58) Field of Search ..... 118/302, 325, 118/406, 410, 415, 641; 427/207.1, 356, 359, 428

(56) References Cited

U.S. PATENT DOCUMENTS

| | | | | |
|---|---|---|---|---|
| 3,921,521 A | | 11/1975 | Kudlich | |
| 4,671,205 A | | 6/1987 | Billeter | |
| 4,911,948 A | * | 3/1990 | McIntyre | 427/591 |
| 4,938,835 A | * | 7/1990 | Ludwig | 156/555 |
| 5,053,254 A | | 10/1991 | Billeter | |
| 5,122,219 A | | 6/1992 | Ludwig | |
| 5,250,320 A | | 10/1993 | Suzuki et al. | |
| 5,667,618 A | | 9/1997 | Lowther | |
| 6,196,127 B1 | | 3/2001 | Yamamoto et al. | |
| 2003/0091744 A1 | * | 5/2003 | Zschaeck | 427/282 |

FOREIGN PATENT DOCUMENTS

| | | | |
|---|---|---|---|
| CH | 648497 | | 3/1985 |
| CH | 663 310 | | 3/1985 |
| EP | 195 099 | A1 * | 9/1986 |
| EP | 0805048 | | 11/1997 |
| EP | 805 048 | A1 * | 11/1997 |
| GB | 1324966 | | 7/1973 |
| NL | 1 010 259 | | 4/1999 |

OTHER PUBLICATIONS

International Search Report from corresponding International Application No. PCT/EP01/03868, dated Aug. 24, 2001.

* cited by examiner

*Primary Examiner*—Katherine A. Bareford
(74) *Attorney, Agent, or Firm*—Alston & Bird LLP

(57) ABSTRACT

Method for applying liquids, in particular thermoplastics, to a substrate, whereby the substance is melted, heated and by means of a nozzle or doctor blade is passed through a perforated cylinder on to a supporting material, distinguished by the perforated cylinder being heated in the arc segment where the liquid passes through, which arc segment covers an angle of up to 180°, preferably between 5° and 90° in relation to the center point of the screen.

52 Claims, 1 Drawing Sheet

METHOD FOR APPLYING LIQUID, PASTY OR PLASTIC SUBSTANCES TO A SUBSTRATE

CROSS-REFERENCE TO RELATED APPLICATIONS

This is a continuation application of PCT/EP01/03868, filed Apr. 5, 2001, which is incorporated herein by reference in its entirety, and also claims the benefit of German Priority Application No. 100 20 101.6, filed Apr. 22, 2000.

FIELD OF THE INVENTION

The invention relates to a method for applying liquids, especially thermoplastics, to a substrate, whereby the substance is melted, heated and applied to a supporting material through a perforated cylinder by means of a nozzle or a doctor blade.

BACKGROUND OF THE INVENTION

It is known that in the field of medicine there are substrates which are coated with high viscosity materials. For certain purposes it is sensible that these coatings do not generate a sealed surface but are applied as dots, which for instance allows sweat and other elimination products to escape from skin under bandages and not cause maceration. An adequate method of achieving this dotted coating is offered by rotational screen extrusion.

In this method a rotating screen has a nozzle located inside it, and through the nozzle the liquid that is to be applied is brought from outside to inside the screen space. It is then extruded out through holes in the screen in the direction of the substrate that is to be coated. Dependent on the substrate transport speed (rotational speed of the screen drum), the screen is lifted up by the substrate. Depending on the adhesion and internal cohesion of the liquid, the slugs which have already swelled so as to adhere to the supporting material draw out the limited stock of hot melt adhesive in the hole to a sharp contour, assisted by the sustained extrusion pressure, on to the supporting material.

On completion of this transport there forms, depending on the rheology of the liquid, over the pre-determined basis area a more or less heavily crumpled domed surface of the slug. The height to base ratio of the slug depends on the hole diameter to drum screen wall thickness ratio, and on the physical characteristics (flow behavior, surface tension and wetting angle on the supporting material) of the liquid.

Regarding substrate materials many types are prescribed and have been used in practice, including films, woven fabrics, knitted textiles, fleeces, gels and foams. In the medical sector there are particular requirements for the supporting materials. The materials must be compatible with the skin, generally permeable to air and/or water, easily formed and ductile. Based on these requirements, often the thinnest and weakest supporting material is preferred. For handling and use the supporting material must however be sufficiently strong and if necessary have only a limited tendency to stretch. Furthermore the supporting material should exhibit sufficient strength and limited tendency to stretch, even when wet through.

The arrangement of nozzle and screen are described in essentials in CH 648 497 A5, improvements to the method are described in EP 0 288 541 A1, EP 0 565 133 A1, EP 0 384 278 A1 and DE 42 31 743 A1.

For coating supporting material with subsequent medical, cosmetic or technical applications, it is preferable to use adhesives, and particularly preferable to use self-adhesives. It is preferable that these belong to the materials classes of solutions, dispersions, pre-polymers and thermoplastic polymers.

It is advantageous to use thermoplastic hot-melt adhesives based on natural and synthetic rubbers and on other synthetic polymers such as for example acrylates, methacrylates, polyurethanes, polyolefins, polyvinyl derivatives, polyesters or silicones, with corresponding additional materials such as adhesive resins, plasticisers, stabilisers and other additives as required.

Their softening point should be higher than 50° C., the application temperature is generally at least 90° C. and preferably between 100° C. and 180° C., or between 180° C. and 220° C. in the case of silicones.

The method therefore requires that the hot-melt adhesive is heated to a corresponding temperature to melt it so that it can run through the screen holes. It is usual for the hot-melt adhesive to be delivered from the feed system already melted, and to be kept in the nozzle at the corresponding temperature. In so doing it is generally attempted to maintain as high a temperature as possible, so that the viscosity of the adhesive remains low thus permitting a higher production speed. There are however tight limits to this method, since at excessive temperatures a rapid process of chemical decomposition takes place in the hot melt, which above all in medical coatings where contact with the skin will occur, is unacceptable.

So as to subject the hot melt adhesive to heat stress for as little time as possible, and thus minimize chemical decomposition, there exist various possibilities which essentially indicate that the screen should be heated so that the adhesive is kept warm in the critical zone of transit through the screen holes, and the risk of chilling avoided.

In the screen or around the screen there can be arranged for instance heater elements which act as radiant heat sources (EP 0 288 541 A1). Heating using hot air has also been described (CH 648 497 A5). These types of heating have however the disadvantage that not only the screen is subjected to radiant energy, but because of dispersion and the permeability of the screen for radiation and air flows, so also are the surroundings and the substrate to be coated.

A further method has been described in which the screen itself serves as heat source, by means of acting as a resistance in an electrical circuit (EP 0 384 278 A1). This requires however wide-ranging constructional features in the machine, so as to insulate the rotating screen electrically from the rest of the machine.

This method also exhibits weaknesses in continuous operation: The rotating screen, operating under rotating screen pressure, is mechanically not very stable, and during prolonged operation this leads to torsional strains with formation of associated bulges. In that circumstance parts of the screen touch the nozzle, which for process technical reasons cannot be insulated, and short circuits occur.

A further disadvantage of this arrangement is that the screen, in areas where it is not in contact with the substance, the substrate to be coated and the nozzle, is significantly more intensely heated than in areas where such contact does occur, and where the substance conveys the heat away. Temperature variations of 40 to 60° C. generally occur. This causes zonal mechanical weakening of the screen material by embrittlement due to overheating. The areas around the margins are most affected by this. The consequence is that in particular at high production speeds there occur damaging fractures of the screen.

The situation of screen heating up until now is characterized above all by the main attention being given to as even as possible heating of the screen over its entire area. This is solved almost ideally by the above mentioned resistance heating. For hot air heating, this objective is pursued using a screen with an enveloping hood (CH 648 497 A5), and for radiant heating by the use of multiple heating elements along the surface.

Disadvantages in heating the entire envelope are that one the one hand chemical decomposition occurs in the thin film of adhesive that remains on the screen and is carried round on its surface, because of the combination of large surface/volume ratio and therefore large contact area with ambient atmospheric oxygen; and on the other hand there is unnecessary loss by radiation into the ambient of part of the energy that is supplied.

Also current technology is that there should be energy introduced into the pulled material where the slug separates from the screen, so as to melt off any strings formed during separation from the screen and prevent formation of long strings (CH 648 497 A5; DE 39 05 342 A1). This is often necessary because the screen can cool off too rapidly after the main part of the slug of adhesive has passed through, and thus the viscosity of the remaining adhesive is increased to the point where string formation can occur. Heating the entire envelope according to current technology provides insufficient energy density at this point, or due to the geometrical configuration the energy cannot be applied sufficiently to the point of separation of adhesive from screen to compensate for the screen cooling off at this point. Therefore some string melt off device as described above is necessary.

SUMMARY OF THE INVENTION

The purpose of this invention is to make available a method that is outstandingly suitable for applying viscous liquids on to a supporting material whilst avoiding the disadvantages inherent in present technology.

This purpose has been achieved by a method that is described in the main application. The subsidiary applications apply to advantageous extensions of the invention.

Accordingly the invention relates to a method for applying liquids, especially thermoplastics, to a substrate, whereby the substance is melted, heated and applied to a supporting material through a perforated cylinder by means of a nozzle or a doctor blade.

The invention is characterized in that the perforated cylinder is heated in the circular arc segment of the cylinder in which the liquid enters through the cylinder, whereby the circular arc segment covers an angle of up to 180°, preferably between 5° and 90° with regard to the center of the screen.

The key aspect of the method is that the screen is exclusively heated or additionally further heated in the circular arc segment in which the passage of the liquid through the screen occurs. This segment covers an angular arc of up to 180°, preferably between 5° and 90° with regard to the center of the screen. The heated circular arc segment can be aligned ahead of or behind the point in the direction of rotation of the screen at which the liquid passes through the screen. It is advantageous for the heated circular arc segment is arranged to cover both sides of the point in the direction of rotation of the perforated cylinder at which the liquid passes through the screen, to ensure heating in the separation zone of the slugs also.

Without wishing to restrict the invention, the following will explore the realization of such screen heating using heater plates, which may be used in future versions as contact heaters and/or radiation heaters and/or convection heaters, and essentially follow the curvature of the screen. These are arranged in the corresponding sector on the inside of the screen or the outside of the screen or on both sides, and are at least in partial areas in contact with the screen or at a distance of not more than 3 mm, preferably up to 0.1 mm. The clearance can also vary over the circular arc segment between 0 and 3 mm, preferably between 0 and 0.1 mm. The plates can be heated electrically or with oil using conventional techniques.

Specially for the contact heating method it should be noted that between the contact heater plates and the screen there will arise friction, this is true particularly when the plates cover a larger arc segment (for example more than 20°), or the screen is running at a high speed (for instance more than 30 m/min). This increased friction leads to a dynamically varying torsion on the screen, which can significantly reduce the working life. This can be avoided as follows:

The heating element lying before the point of extrusion (against the direction of rotation) forms a continuously reducing gap, leading along the direction of rotation to full contact with the screen. It has been shown to be favourable if the gap reduces continuously along the direction of rotation from 3 mm to 0 mm, and preferably from 0.3 mm to 0 mm. A nozzle constructed in this way increases the temperature of the residual adhesive in the screen, without the screen initially being in contact with the heater element, and generates contact only when the viscosity of the adhesive has been reduced by increasing temperature to the point where it does not contribute a torsional force on the screen. The adhesive can increasingly take over the function of a lubricating film between screen and heater element.

The formation of a lubricant film will in an advantageous version be supported in that the surface of the heater plate facing the screen will at least in some areas have a serrated surface with a roughness between 0.001 mm and 1 mm, preferably 0.01 mm to 0.5 mm, for example a set of grooves along the surface in the direction of rotation.

The heating arc segment lying after the point of extrusion is arranged as follows, so as to ensure heating of the screen in the area of separation of the slugs: The clearance from the screen remains constant in the range 0 mm to 3 mm, preferred however is 0.01 mm to 0.2 mm.

To accelerate the heating up of the screen and the adhesive, in addition a heating element can be fitted outside the screen in the circular arc segment before the point of pass through in the direction of rotation. This heating element will be shaped to follow the curvature of the screen. The heater plate can be heated electrically or with oil using conventional techniques. This is particularly applicable when high coating speeds are envisaged.

It is advantageous to arrange the external heater plates so that they cover a circular arc segment that in relation to the circular arc segment within the screen is 5° to 10° smaller, preferably 6°–7°. Furthermore it is favourable that the heater plate should have a clearance from the screen of 0.0 mm to 3 mm, preferably 0.0 mm to 0.1 mm. Here also the distance can be continuously reduced, so that the adhesive forms a lubricating film.

From a design viewpoint it is advantageous to have one or more heater plates mounted directly on the nozzle through which the thermoplastic is fed into the screen, or to construct the nozzle itself as a heating element in the circular arc segment where the liquid passes through. To avoid leaks in the system, and ensure sufficient heating on the screen even in the marginal zones, the heater element or the area of the nozzle where the heating is located, should at least partially extend continuously into the lateral containment lip of the nozzle mouth.

A nozzle arranged in such a way permits the viscosity of the adhesive to be briefly lowered, without chemical decomposition occurring, and yields a long operating life for the screen in production, since neither marginal embrittlement nor torsional forces arising from the strength of the adhesive occur. In addition, because this method heats the adhesive following the extrusion point in the direction of rotation, in many cases it avoids the need for an additional melt-off device for the strings.

In a particular version of the method, instead of heater plates as described above, radiation heat sources such as infrared heaters are used as sources of heat. It is found however that these are effective only in the circular arc segment where the liquid is extruded through the screen, covering an arc of 0° to 180°, preferably from 5° to 45° in relation to the mid-point of the screen.

Placing the heater elements on the nozzle or directly integrating them into the nozzle can lead to undesirable heating of the base body due for instance to heat conduction effects. A cooling medium such as thermal oil or water must be used to convey this heat away. A better method however is to use the liquid being applied as a coating itself to carry away the surplus heat. To achieve this, the liquid is fed to the nozzle at a temperature lower than the target temperature for application as a coating, so that in taking up the surplus heat it is heated to the target temperature for application as a coating. For this purpose it is advantageous to provide suitably arranged circulation channels, for example a double-walled infeed tube located centrally to the base nozzle body, in which the liquid first flows through the external covering nearest the heating elements, and is the routed into the inner distributor pipe.

The method thus described is advantageous for applying coatings with liquids that have a dynamic null viscosity of 0.1 to 1000 Pas, preferably with a dynamic null viscosity of 1 to 500 Pas.

Substance suitable for application include all inorganic and organic compounds whose viscosity can be brought into the ranges stated above, also dispersions, emulsions, solutions and melts. For coating supporting material with subsequent medical, cosmetic or technical applications, it is preferable to use adhesives, and particularly preferable to use self-adhesives. It is preferable that these belong to the materials classes of solutions, dispersions, pre-polymers and thermoplastic polymers.

It is advantageous to use thermoplastic hot-melt adhesives based on natural and synthetic rubbers and on other synthetic polymers such as for example acrylates, methacrylates, polyurethanes, polyolefins, polyvinyl derivatives, polyesters or silicones, with corresponding additional materials such as adhesive resins, plasticisers, stabilisers and other additives as required.

Their softening point should be higher than 50° C., the application temperature is generally at least 90° C. and preferably between 100° C. and 180° C., or between 180° C. and 220° C. in the case of silicones. Where necessary a post-application cross-linking by means of UV or electron beam radiation can be applied, to achieve particularly advantageous characteristics in the hot melt adhesive.

In particular, hot melt adhesives based on block copolymers exhibit a multitude of variation possibilities, since targeted reduction of the glacial transition temperature of the self-adhesive as a consequence of selection of the tack agent, the plasticiser, the polymer molecule size and the molecular weight distribution of the composition components ensures the required functionally appropriate adhesive properties to the skin, even at critical points in the human mobility structure.

For particularly strongly adhesive systems, the hot melt adhesive preferred is based on block copolymers, especially A-B-, A-B-A-block copolymers, or mixtures thereof. The hard phase A is predominantly polystyrene or its derivates, and the soft phase B contains ethylene, propylene, butylene, butadine, isoprene or mixtures thereof, with particular preference for ethylene and butylene or mixtures thereof.

Polystyrene blocks however can also be included in the soft phase B, up to 20% by weight. The total styrene content should however always remain below 35% by weight. Preferably the styrene proportion should be between 5% and 30% by weight, since a lower styrene proportion causes the adhesive to be more ductile.

In particular the targeted mixing of di-block and tri-block copolymers is advantageous, for which it is preferable for the proportion of di-block copolymer to be less than 80% by weight.

In an advantageous arrangement the hot melt adhesive will exhibit the following composition:

| | | |
|---|---|---|
| 10% to 90% | by weight | block copolymers, |
| 5% to 80% | by weight | Tack agents such as oils, waxes, resins and / or mixtures therefore, preferably mixtures of resins and oils, |
| less than 60% | by weight | plasticisers, |
| less than 15% | by weight | additives, |
| less than 5% | by weight | stabilisers. |

The aliphatic or aromatic oils, waxes and resins that serve as tack agents are preferably hydrocarbon oils, waxes and resins, of which oils such as paraffin hydrocarbon oils or waxes such as paraffin hydrocarbon waxes due to their consistency have the best effectiveness for adhesion to the skin. As plasticisers, medium or long chain fatty acids and or esters are used. These additives serve also to adjust the tackiness characteristics, and the stability. Where necessary, further stabilisers and other additives are used.

The adhesive can be filled out with mineral fillers, fibres, microbubbles or microspheres.

In particular for medial supporting materials the requirements for adhesive properties are high. For an ideal application the hot melt adhesive should have high initial adhesion. The functionally adjusted tack on the skin and on the back of the support material should be present. Furthermore, so that no wrinkling occurs, a high shear strength is also necessary in the hot melt adhesive. The necessary functionally appropriate adhesion to the skin and to the back of the support material is achieved by targeted reductions in the glacial transition temperature as a consequence of the selection of the tack agent, the plasticiser, the polymer molecular size and molecular distribution of the components used. The high shear strength of the adhesive is achieved due to the high cohesiveness of the block copolymers. The good initial adhesion is generated by the palette of tack agents and plasticisers employed.

Product characteristics such as initial adhesion, glacial transition temperature and shear stability can be will quantified by dynamic mechanical frequency measurement. For this a rheometer with shear stress control is used.

The results of the measurement method give information regarding the physical characteristics of a material by measuring the visco-elastic component. For this at a pre-selected temperature the hot melt adhesive is placed between two plane parallel plates and is vibrated at variable frequencies and small deformations (within the linear visco-elastic range). The mountings are computer-linked and the quotient (Q=tan δ) between the losses module (G" viscous component) and the retention module (G' elastic component) is determined $$Q=\tan\delta=G''/G'$$

For subjective assessment of the tack, a high frequency is selected, and the for shear strength a low frequency. Higher value numbers indicate better initial tack and poorer shear stability.

The glacial transition temperature of the temperature at which the amorphous or partially crystalline polymers switch over from liquid or rubber elastic state into hard elastic or glacial state, and vice versa (Römpp Chemie-Lexikon, 9th edition, volume 2, page 1587, Georg Thieme Verlag Stuttgart—New York, 1990). It corresponds to the maximum temperature function for a particular frequency. Particularly for medical applications, a relatively low glacial transition temperature is necessary.

| Description | $T_G$ low frequency | Ductility low frequency/RT | Initial tack high frequency/RT |
|---|---|---|---|
| Hot melt adhesive A | −12 ± 2° C. | tan δ = 0.32 ± 0.03 | tan δ = 1.84 ± 0.03 |
| Hot melt adhesive B | −9 ± 2° C. | tan δ = 0.22 ± 0.03 | tan δ = 1.00 ± 0.03 |

It is advantageous that hot melt adhesives are adjusted so that at a frequency of 0.1 rad/s they have a dynamic-complex glacial transition temperature of lower than 15° C., preferably between 50° C. and −30° C., with special preference for between −3° C. and −15° C.

If is found preferable that hot melt adhesives at a frequency of 100 rad/s at 25° C. should have a ratio of viscous component to elastic component greater than 0.7, and specially preferred between 1.0 and 5.0, and at a frequency of 0.1 rad/s at 25° C. should have a ratio of viscous component to elastic component less than 0.6, and specially preferred between 0.4 and 0.02.

The rounded or polygeometrical body forms can take various forms. The preference is for flattened hemispheres. However other forms and patterns can be extruded on to the supporting material, for instance in the image of an alphanumeric character, or patterns such as grids, strips, concentrations of slugs and zig-zag lines.

The adhesive can be evenly distributed on the supporting material, or if functionality so requires can be distributed over the surface at differing strengths or densities, which it is found can be improved by varying the angle between the supporting material and the screen.

All rigid and elastic surface forms of synthetic and natural materials are suitable as supporting materials. Preferably supporting materials should be chosen according to the application of the adhesive, so that technical requirements or characteristics of a functionally satisfactory dressing. Examples are textiles such as woven materials, knitted materials, stacked materials, fleeces, laminates, foams and papers. Furthermore, these materials can be pre-processed or post-processed. Usual pre-processing are corona and waterproofing; usual post-processing is calandering, malleablizing, backing, punching and covering.

In particular when directly coating a supporting material it must exhibit a certain strength and tightness so as to prevent during the process of coating the slugs penetrating too far into the supporting material or even penetrating clean through it.

In a preferred version of the method during the invention the slugs and/or polygeometrical body forms were passed on to a second supporting material, after initial application of the coating. The second supporting material in this case is the real supporting material, the first supporting material acts only as an auxiliary supporting material. Such an auxiliary supporting material can also take the form of a non-adhering roller or belt.

A preferred version of the auxiliary supporting material is a roller with non-adhering surface, where the non-adhering surface of the roller is of silicone or fluorine-containing compound, or plasma-coated separation system. These can be in the form of a coating with a surface density of 0.001 g/m$^2$ to 3000 g/m$^2$ preferably 100 g/m$^2$ to 2000 g/m$^2$.

When performing the method it is desirable that the non-adhering surface of the roller is set to a temperature between 0° C. and 200° C., preferably lower than 60° C., and specially preferably lower than 25° C. This is particularly advantageous if the non-adhering characteristics of the surface of the roller are so constituted that the adhesive applied is self-adhesive even to a cooled roller (<25° C.).

Also a post-processing calandering of the coated product and/or a pre-treatment of the supporting material such a corona bombardment, can be advantageous for better anchoring of the adhesive layer.

Further more a treatment of the hot melt adhesive with an electron radiation cross-linking post-process or a UV radiation can lead to improvement in the desired characteristics.

It is preferable that the supporting material is coated at a rate greater than 2 m/min, and preferably 20 to 200 m/min.

The proportion of the surface that is coated with hot melt adhesive should be a minimum of 1%, and can be up to about 99%, for special products 15% to 95% is preferable, with 550% to 95% specially preferable. This can where necessary be achieved by multiple passes, whereby where necessary also hot melt adhesives with different characteristics can be applied.

Partial application allows controlled channels for dissipation of trans-epidermal water losses and improves evaporation from the skin when sweating, particularly if supporting materials permeable to air and water are used. This also avoids irritations of the skin that may be occasioned by an accumulation of bodily fluids. The dissipation channels operate to disperse water even when multiple layers of bandages are applied.

In a preferred version form of the discovered method, such a supporting material exhibited an air pass-through rate greater than 1 cm$^3$/(cm$^2$*s), preferably 10 to 150 cm$^3$/(cm$^2$*s), and a water pass-through rate greater than 200 g/(m$^2$*24h), preferably 500 to 5000 g/(m$^2$*24h).

In a further preferred version form in accordance with the invention method, the supporting material exhibited an adhesion to steel on the back face of the supporting material of at least 0.5 N/cm, and especially an adhesion force between 2 N/cm and 20 N/cm.

Epilation of the relevant area of the body and the mass transfer to the skin can be dispensed with due to the high cohesiveness of the adhesive, because the adhesive does not anchor to skin and hair, rather the anchoring of the adhesive to the supporting material is up to 20 N/cm (test piece width) which is good for medical applications.

The intentional break points in the coating mean that skin is no longer pushed together or against itself on stripping. The non-displacement of skin and the low epilation lead to a freedom from pain not previously encountered for such strongly adhesive systems. Furthermore the individual biomechanical adhesion force control, which exhibits a proven reduction on the adhesive force of this plaster, supports ease of removal. The applied supporting material shows good proprio-receptive effects.

In a further advantageous version the self-adhesive is foamed before application to the supporting material.

For this the self-adhesive is foamed preferably with passive gases such as nitrogen, carbon dioxide, inert gases, hydrocarbons or air, or mixtures thereof. In many cases foaming by thermally-decomposing gas evolution agents such as azo compounds, carbonate compounds and hydrazine compounds have been found to be suitable.

The degree of foaming, i.e. the proportion of gas, should be at least 5% by volume and can reach up to 85% by volume. In practice, values between 10% by volume and 75% by volume, preferably 50% by volume have proven successful. When processed at relatively high temperatures of about 100° C. and comparatively high internal pressures, there arise very open-pored adhesive foam coatings, which are particularly good for air and water permeability.

The advantageous characteristics of foamed self-adhesive coatings such as low consumption of adhesive, high initial tack and good ductility even on irregular surfaces due to the elasticity and plasticity and the initial tack mean that it is the optimum technique in some very special areas of medical products.

By the use of active breathing coatings in connection with elastic and also active breathing supporting materials, the user senses subjectively more comfort in wearing the bandage.

A particularly suitable method for production of foamed self-adhesives operates on the foam-mix system. For this the thermoplastic self-adhesive is transformed in a stator/rotor system under high pressure at a temperature above the softening point into a mixture with gases provided such as for example nitrogen, air or carbon dioxide in various volumetric proportions (about 10% by volume up to 80% by volume).

Whilst the gas pre-pressurization is higher than 100 bar, the gas/thermoplastic mixture pressure in the system is between 40 and 100 bar, preferably between 40 and 70 bar. The adhesive foam thus generated can then be fed by a pipe into the extrusion nozzle.

Due to the foaming of the self-adhesive and the resulting open pores in the mass together with use of a porous supporting material, the product with its adhesive coating has good water vapour and air permeability. The necessary adhesive mass quantity is substantially reduced without compromising the adhesiveness properties. The adhesive mass exhibits a surprisingly high tack, since per gram of mass more volume for wetting the base material on to which it is to be stuck is available, and the plasticity of the adhesive mass is enhanced by the foam structure. Also the anchoring on to the supporting material is improved by this means. Apart from this the foamed adhesive coating lends the product a soft an pleasant feel, as mentioned above.

Foaming generally causes the viscosity of the adhesive mass to be reduced. This means that the energy of melting is reduced, and even thermally unstable supporting materials can be directly coated.

The outstanding characteristics of the supporting materials coated with self-adhesive in accordance with the invention lay the basis for use for medical products, particularly plasters, medical fixtures, wound coverings, doped systems, in particular for such which release substances near orthopaedic or phlebologocal bandages.

Finally the supporting material after the coating process can be covered with a non-adhering supporting material such as siliconized paper, or can be provided with a wound dressing or padding.

Particularly advantageous is that if the supporting material can be sterilized, gamma sterilization is preferred. Particularly suitable for post-process sterilization are hot melt adhesives based on block copolymers, which contain no double bonds. This applies particularly for styrene-butylene-ethylene-styrene block copolymerisates or styrene-butylene-styrene block copolymerisates. No changes to the adhesive characteristics relevant to the application arise from this.

This is outstandingly suitable for technically reversible fixings, which on removal are not permitted to injure or damage various underlying materials such as paper, plastic, glass, textiles, wood, metals or minerals.

Finally, technically permanent adhesion bonds can be produced which only by partial splitting of the underlying material can be separated.

BRIEF DESCRIPTION OF THE DRAWING

A chart can be presented showing the advantageous version forms of the subject of the invention, without intending to unnecessarily set bounds to the scope of the invention.

It shows.

DETAILED DESCRIPTION OF THE PREFERRED EMBODIMENTS

Figure 1:
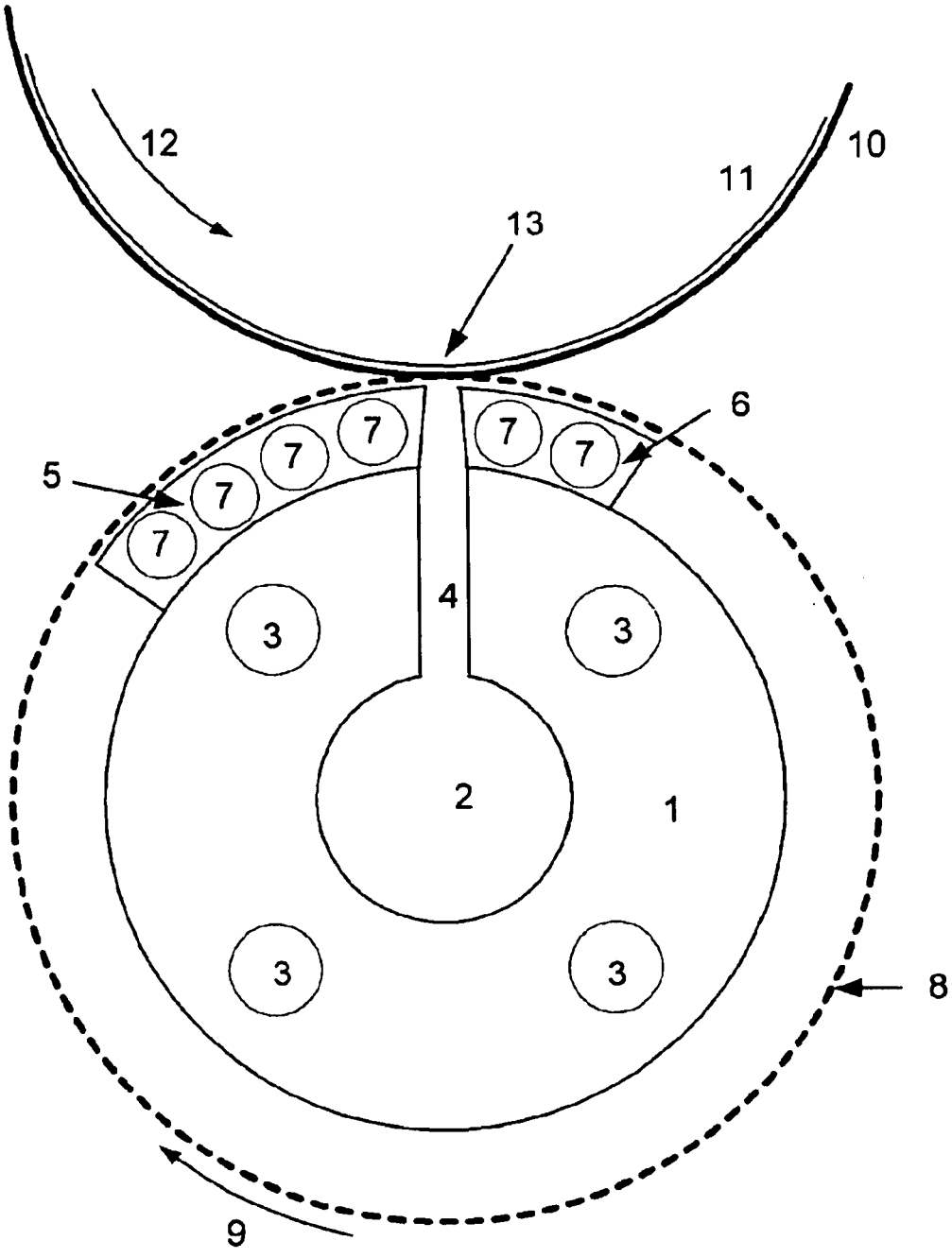
FIG. 1: a section of an extrusion coating unit, which operates in accordance with this invention.

FIG. 1 shows a section of an extrusion coating unit, which operates in accordance with this invention. The supporting material 10 is fed through the gap between the screen 8 (direction of rotation 9) and the counter-pressure roller 11 (direction of rotation 12). The liquid extruded through screen 8 coats the supporting material 10. For this the liquid flows through a distribution pipe 2 located axially in the nozzle base body 1 through the riser slot 4 to the exit point through the screen 13.

The nozzle base body and with it the liquid are heated by thermal oil, which is fed through the respective holes 3. Mounted on the nozzle are heater plates 5 and 6 which are heated by cartridge heaters 7 and which in accordance with the invention are only on one sector of the screen. These are arranged both before and after the extrusion point of the liquid in the sense of rotation of the screen.

EXAMPLE

In a rotary extrusion machine with 1 m width of coating, which is equipped with the usual devices for guiding an endless belt such as roll-off, roll-on path edge controls and path tension measuring systems, and whose coating part comprises a rotating round screen, a nozzle within the screen, and a counter-pressure roller with which the nozzle is pressed to the coating nozzle, a thermoplastic adhesive is applied to a paper strip.

| | |
|---|---|
| Process temperature in feed system and nozzle | 140° C. |
| Process temperature around the screen holes | 150° C. |
| Surface weight of the paper strip | 65 g/m$^2$ |
| Screen | 40 mesh, hole size 0.3 mm. |

The heater elements are arranged as follows:

Arc segment at nozzle before extrusion opening:

| | |
|---|---|
| Arc segment angle | 60 degrees |
| Arc segment radius | Screen radius to 0.1 mm less than screen radius |
| Heating of arc segment | electric, 12 kW |

Arc segment at nozzle after extrusion opening:

| | |
|---|---|
| Arc segment angle | 60 degrees |
| Arc segment radius | Screen radius to 0.03 mm less than screen radius |
| Heating of arc segment | electric, 12 kW |

Externally mounted heater plates before extrusion opening:

| | |
|---|---|
| Arc segment angle | 54 degrees |
| Arc segment radius | Screen radius to 0.1 mm more than screen radius |
| Heating of arc segment | electric, 12 kW |

The heating of the screen is provided exclusively by the heater elements described. Using this equipment a deposition density of 40 g/m$^2$ is achieved. The temperature loading can be held to less than the lower critical temperature of 150 degrees for this screen. A coated area of several tens of thousands of square metres of materials strip can be coated at a speed of 50 m/min without perceptible damage or traces of wear on the screen or the screen heating elements. Contact between the coating nozzle and the screen does not give rise to any damage to the screen due to torsional forces. If a subsequent chemical investigation of the adhesive, no kind of onset points of chemical decomposition were found. The maximum attainable production speed was found to be about 100 m/min.

What is claimed is:

1. A method for applying a liquid to a substrate, comprising the stops of:

heating a substance to produce a heated liquid; and passing the liquid through an arc segment of a perforated cylinder onto a supporting material, said perforated cylinder being heated in the arc segment by one or more heater plates where the liquid passes through said arc segment covering an angle of up to 180° in relation to the center point of the cylinder.

2. The method according to claim 1, wherein the heating step comprises heating a substance to produce a liquid melt.

3. The method for applying a liquid to a substrate according to claim 2, wherein the passing step comprises passing the liquid melt through the arc segment in the perforated cylinder through the use of a nozzle or doctor blade.

4. The method for applying a liquid to a substrate according to claim 2, wherein the heating stop comprises heating a thermoplastic material to produce the liquid melt.

5. The method for applying a liquid to a substrate according to claim 2, wherein the heating step comprises heating a hot-melt adhesive to produce the liquid melt.

6. The method far applying a liquid to a substrate according to claim 1, wherein the are segment covers an angle between 5° and 90° in relation to the center point of the cylinder.

7. The method for applying a liquid to a substrate according to claim 1, wherein the passing step comprises passing the liquid through the arc segment of a perforated cylinder that is rotating in a direction of rotation, wherein said arc segment is arranged on both sides of the point where the liquid passes through the perforated cylinder in the direction of rotation of the perforated cylinder.

8. The method for applying a liquid to a substrate according to claim 1, wherein the perforated cylinder is formed of a screen and the one or more heater plates are in contact with the screen for at least some parts of to arc segment.

9. The method for applying a liquid to a substrate according to claim 1, wherein the perforated cylinder is formed of a screen and the clearance between the one or more heater plates and the screen is not more than 3 mm.

10. The method for applying a liquid to a substrate according to claim 9, wherein the clearance between the one or more heater plates and the screen is up to 0.1 mm.

11. The method for applying a liquid to a substrate according to claim 1, wherein the perforated cylinder is formed of a screen and the one or more heater plates are arranged on the inner side of the screen, on the outer side of the screen or on both sides of the screen.

12. The method for applying a liquid to a substrate according to claim 11, comprising a heater plate lying inside the screen and a heater plate on the outside of the screen following the curvature of the screen and forming a circular arc segment before the pass through point of the liquid inch through the perforated cylinder, wherein the heater plate on the outside of the screen forms an angle from the center paint of the cylinder that is 5° to 10° smaller than the angle that is formed by the heater plate lying inside the screen.

13. The method for applying a liquid to a substrate according to claim 12, wherein the heater plate on the outside of the screen forms an angle from the center point of the cylinder that is 6° to 7° smaller than the angle that is formed by the heater plate lying inside the screen.

14. The method for applying a liquid to a substrate according to claim 1, wherein the arc segment is heated by one or more heater plates attached to a nozzle through which the liquid melt is fed to the perforated cylinder.

15. The method for applying a liquid to a substrate according to claim 14, wherein the heater element at least partly overlaps without interruption a side margin limiting lip of the nozzle exit opening.

16. The method for applying a liquid to a substrate according to claim 1, wherein the one or more heater plates are at least partially heated by the liquid itself.

17. The method for applying a liquid to a substrate according to claim 1, wherein the supporting material is a roller or belt with a non-adhering surface.

18. The method for applying a liquid to a substrate according to claim 17, wherein the non-adhering surface is formed of a compound of silicone or fluorine.

19. The method for applying a liquid to a substrate according to claim 1, wherein the substance at the process temperature has a dynamic null viscosity of 0,1 Pas to 1000 Pas.

20. The method for applying a liquid to a substrate according to claim 19, wherein the substance at the process temperature has a dynamic null viscosity of 1 Pas to 500 Pas.

21. The method for applying a liquid to a substrate according to claim 19, wherein the liquid is selected from the group consisting of a solution, a dispersion, a prepolymer and a thermoplastic material.

22. A method for applying a liquid to a substrate, comprising the steps of:

heating a substance to produce a heated liquid; and passing the liquid through a nozzle to an arc segment of a perforated cylinder onto a supporting material, said perforated cylinder being heated in the arc segment where the liquid passes through and said arc segment covering an angle of up to 180° in relation to the center point of the cylinder, wherein the nozzle is arranged as a heater element for the arc segment where the liquid passes through.

23. The method for applying a liquid to a substrate according to claim 22, wherein the heated area of the nozzle at least partly overlaps without interruption a side margin limiting lip of the nozzle exit opening.

24. The method for applying a liquid to a substrate according to claim 22, wherein the heating step comprises heating a substance to produce a liquid melt.

25. The method for applying a liquid to a substrate according to claim 24, wherein the heating step comprises heating a thermoplastic material to produce the liquid melt.

26. The method for applying a liquid to a substrate according to claim 24, wherein the heating step comprises heating a hot-melt adhesive to produce the liquid melt.

27. The method for applying a liquid to a substrate according to claim 22, wherein the arc segment covers an angle between 5° and 90° in relation to the center point of the cylinder.

28. The method for applying a liquid to a substrate according to claim 22, wherein the substance at the process temperature has a dynamic null viscosity of 0.1 Pas to 1000 Pas.

29. The method for applying a liquid to a substrate according to claim 28, wherein the substance at the process temperature his a dynamic null viscosity of 1 Pas to 500 Pas.

30. The method for applying a liquid to a substrate according to claim 28, wherein the liquid is selected from the group consisting of a solution, a dispersion, a prepolymer and a thermoplastic material.

31. The method for applying a liquid to a substrate according to claim 22, wherein the passing step comprises passing the liquid through the arc segment of a perforated cylinder that is rotating in a direction of rotation, wherein said arc segment is arranged on both sides of the point where the liquid passes through the perforated cylinder in the direction of rotation of the perforated cylinder.

32. A method for applying a liquid to a substrate, comprising the steps of:

heating a substance to produce a heated liquid; and passing the liquid through an arc segment in a perforated cylinder onto a supporting material comprised of a roller or belt with a non-adhering surface formed of a compound of silicone or fluorine, said perforated cylinder being heated in the arc segment where the liquid passes through and said arc segment covering an angle of up to 180° in relation to the center point of the cylinder, wherein the non-adhering surface is formed using a plasma-coated separation system.

33. The method according to claim 32, wherein the heating step comprises heating a substance to produce a liquid melt.

34. The method for applying a liquid to a substrate according to claim 33, wherein the passing step comprises passing the liquid melt through the arc segment in the perforated cylinder through the use of a nozzle or doctor blade.

35. The method according to claim 32, wherein said arc segment of said perforated cylinder is heated by one or more heater plates.

36. The method for applying a liquid to a substrate according to claim 32, wherein the arc segment covers an angle between 5° and 90° in relation to the center paint of the cylinder.

37. The method for applying a liquid to a substrate according to claim 32, wherein the passing step comprises passing the liquid through the arc segment of a perforated cylinder that is rotating in a direction of rotation, wherein said arc segment is arranged on both sides of the point where the liquid passes through the perforated cylinder in the direction of rotation of the perforated cylinder.

38. The method for applying a liquid to a substrate according to claim 32, wherein the substance at the process temperature has a dynamic null viscosity of 0.1 Pas to 1000 Pas.

39. The method for applying a liquid to a substrate according to claim 38, wherein the substance the process temperature has a dynamic null viscosity of 1 Pas to 500 Pas.

40. The method for applying a liquid to a substrate according to claim 39, wherein the liquid is selected from the group consisting of a solution, a dispersion, a prepolymer, and a thermoplastic material.

41. A method for applying a liquid to a substrate, comprising the steps of:

heating a substance to produce a heated liquid; and passing the liquid through an are segment in a perforated cylinder onto a supporting material comprised of a roller or bolt with a non-adhering surface formed of a compound of silicone or fluorine, said perforated cylinder being heated in the arc segment where the liquid passes through and said arc segment covering an angle of up to 180° in relation to the center point of the cylinder, wherein the non-adhering surface is applied with a surface density of 0.001 $g/m^2$ to 3000 $g/m^2$.

42. The method according to claim 41, wherein the heating step comprises heating a substance to produce a liquid melt.

43. The method for applying a liquid to a substrate according to claim 42, wherein the passing step comprises passing the liquid melt through the arc segment in the perforated cylinder through the use of a nozzle or doctor blade.

44. The method according to claim 41, wherein said arc segment of said perforated cylinder is heated by one or more heater plates.

45. The method for applying a liquid to a substrate according to claim 41, wherein the arc segment covers an angle between 5° and 90° in relation to the center point of the cylinder.

46. The method for applying a liquid to a substrate according to claim 41, wherein the passing step comprises passing the liquid through the arc segment of a perforated cylinder that is rotating in a direction of rotation, wherein said arc segment is arranged on both sides of the point where the liquid passes through the perforated cylinder in the direction of rotation of the perforated cylinder.

47. The method for applying a liquid to a substrate according to claim 41, wherein the substance at the process temperature has a dynamic null viscosity of 0.1 Pas to 1000 Pas.

48. The method for applying a liquid to a substrate according to claim 47, wherein the substance at the process temperature has a dynamic null viscosity of 1 Pas to 500 Pas.

49. The method for applying a liquid to a substrate according to claim 48, wherein the liquid is selected from the group consisting of a solution, a dispersion, a pre-polymer, and a thermoplastic material.

50. The method for applying a liquid to a substrate according to claim 41, wherein the non-adhering surface is applied with a surface density of 100 to 2000 g/m$^2$.

51. A method for applying a liquid melt to a substrate, comprising the steps of:

heating a thermoplastic substance to produce a liquid melt; and passing the liquid melt through an arc segment in a perforated cylinder through the use of a nozzle or a doctor blade onto a supporting material, said perforated cylinder being heated in the arc segment by one or more heater plates whore the liquid melt passes through and said arc segment covering an angle of between 5° and 90° in relation to the center point or the cylinder.

52. An apparatus for applying a liquid to a substrate, comprising:

means for heating a substance to produce a heated liquid;

a perforated cylinder having an arc segment through which the liquid can pass through, said arc segment covering an angle of up to 180° in relation to the center point of the cylinder;

means for passing the heated liquid through the arc segment; and one or more heater plates for heating the arc segment of the perforated cylinder where the liquid melt passes through.

* * * * *